US006568543B1

(12) United States Patent
Schneider

(10) Patent No.: US 6,568,543 B1
(45) Date of Patent: May 27, 2003

(54) BOOKEND FOR FORMING FROM A SINGLE PIECE OF SHEET METAL

(76) Inventor: Wallace Schneider, 41 W. 72nd St., #8A, New York, NY (US) 10023-3483

( * ) Notice: Subject to any disclaimer, the term of this patent is extended or adjusted under 35 U.S.C. 154(b) by 0 days.

(21) Appl. No.: 10/027,184

(22) Filed: Dec. 26, 2001

(51) Int. Cl.[7] ..... A47B 65/00
(52) U.S. Cl. ..... 211/43; 211/42; D19/34.1
(58) Field of Search ..... 211/42, 43; D19/34.1

(56) References Cited

U.S. PATENT DOCUMENTS

| | | | | | |
|---|---|---|---|---|---|
| D73,215 | S | | 8/1927 | Wessel | |
| 2,165,255 | A | * | 7/1939 | Hamilton | 248/455 |
| 3,604,564 | A | | 9/1971 | Weyll, Jr. | 211/43 |
| 3,718,308 | A | * | 2/1973 | Hainault | 211/42 |
| 4,460,146 | A | * | 7/1984 | Raggiotti | 248/456 |
| 4,463,854 | A | | 8/1984 | MacKenzie | 211/43 |
| 4,842,460 | A | | 6/1989 | Schlesch | 410/121 |
| 5,016,763 | A | * | 5/1991 | Martin | 211/184 |
| D341,621 | S | | 11/1993 | Evenson | D19/34.1 |
| 5,607,135 | A | * | 3/1997 | Yamada | 248/456 |

* cited by examiner

*Primary Examiner*—Daniel P. Stodola
*Assistant Examiner*—Erica B. Harris
(74) *Attorney, Agent, or Firm*—Richard L. Miller, Registered Patent Agent

(57) ABSTRACT

A bookend that is formed from a single piece of sheet metal that is folded into a base, an upright, and a brace that has a free end. The single piece of sheet metal has a pair of edges and a fold line. The fold line and one edge form the base therebetween and the fold line and the other edge form the upright therebetween. The upright is maintained upright relative to the base by the brace. The base is divided into an outer base and an inner base. The inner base is cut out of the outer base and is coplanar therewith when folded outwardly therefrom. The upright is maintained vertical relative to the base when the brace is folded diagonally outwardly from the upright and the free end of the brace is affixed to the inner base.

9 Claims, 1 Drawing Sheet

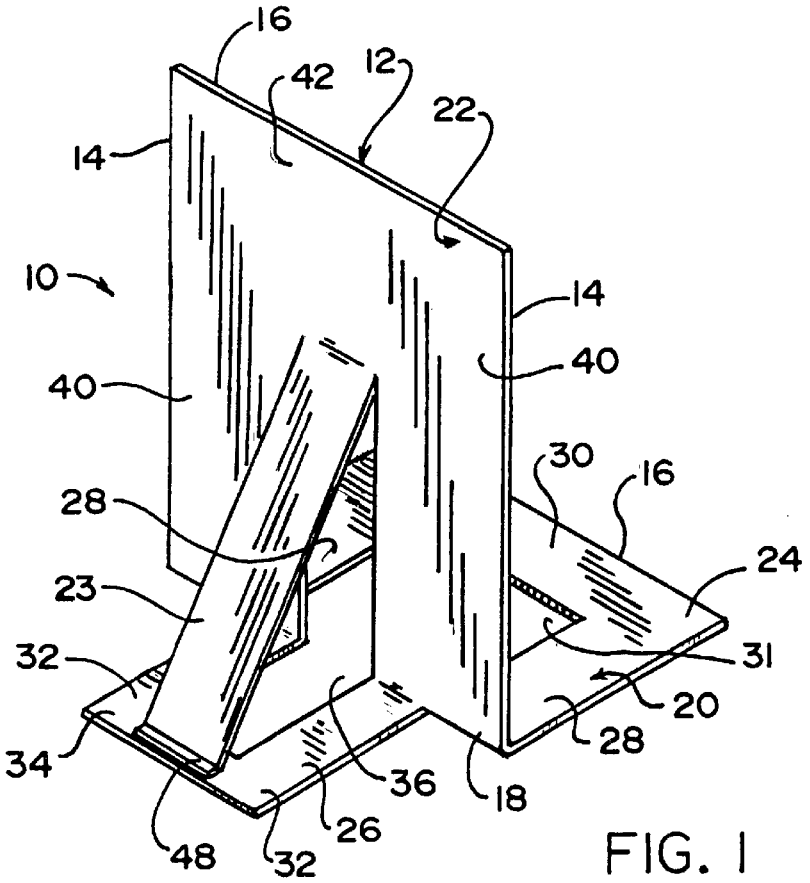
FIG. 1
FIG. 2
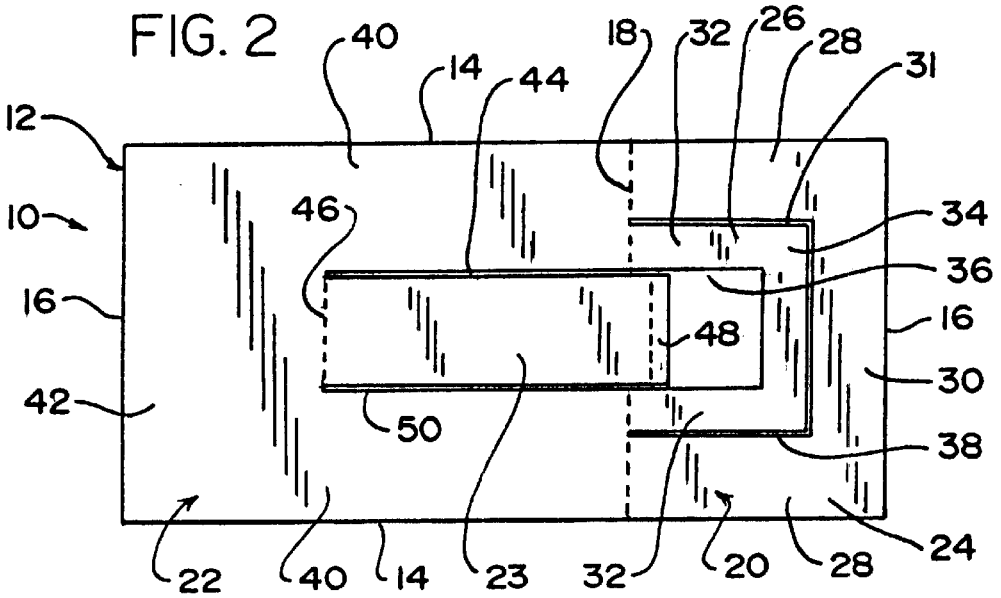

BOOKEND FOR FORMING FROM A SINGLE PIECE OF SHEET METAL

BACKGROUND OF THE INVENTION

1. Field of the Invention

The present invention relates to a bookend. More particularly, the present invention relates to a bookend for forming from a single piece of sheet metal.

2. Description of the Prior Art

Numerous innovations for bookends have been provided in the prior art that will be described. Even though these innovations may be suitable for the specific individual purposes to which they address, however, they differ from the present invention.

A FIRST EXAMPLE, U.S. Pat. No. Des. 73,215 to Wessel teaches the ornamental design for a book-end.

A SECOND EXAMPLE, U.S. Pat. No. Des. 341,621 to Evenson teaches the ornamental design for a book-end.

A THIRD EXAMPLE, U.S. Pat. No. 3,604,564 to Weyll, Jr. teaches one piece of sheet material formed to provide a horizontal base with a vertical book-supporting panel at one edge of the base. An inclined ledge is provided at the upper edge of the panel and the side edges of the panel are formed with a pair of side flanges. A central flange is struck out from the panel midway between and parallel to the side flanges, and either of the side flanges may coact with the central flange to afford a pair of finger pieces for handling the book end. The base of the book end is equipped with a magnet for holding the same on metal shelving.

A FOURTH EXAMPLE, U.S. Pat. No. 4,463,854 to MacKensie teaches a book support assembly that comprises a system of adjustable bookends including two end members connected together by a relaxed cord which cord is adjustable in length by use of a manually operated mechanical windlass device. The book support assembly is convertible from bookends to a lectern.

A FIFTH EXAMPLE, U.S. Pat. No. 4,842,460 to Schlesch teaches a releasable cargo anti-skid block for gripping the cargo bed of a vehicle that comprises a rigid body having a cargo engageable upstanding side and a cargo bed engageable bottom. The bottom and upstanding side join at a corner edge. Gripping apparatus on the bottom of the body extends lengthwise along the bottom. The gripping apparatus are fixed with respect to the body for forcibly but releasably gripping the surface of the cargo bed of the vehicle.

It is apparent that numerous innovations for bookends have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a bookend for forming from a single piece of sheet metal that avoids the disadvantages of the prior art.

ANOTHER OBJECT of the present invention is to provide a bookend for forming from a single piece of sheet metal that is simple and inexpensive to manufacture.

STILL ANOTHER OBJECT of the present invention is to provide a bookend for forming from a single piece of sheet metal that is simple to use.

BRIEFLY STATED, STILL YET ANOTHER OBJECT of the present invention is to provide a bookend that is formed from a single piece of sheet metal that is folded into a base, an upright, and a brace that has a free end. The single piece of sheet metal has a pair of edges and a fold line. The fold line and one edge form the base therebetween and the fold line and the other edge form.the upright therebetween. The upright is maintained upright relative to the base by the brace. The base is divided into an outer base and an inner base. The inner base is cut out of the outer base and is coplanar therewith when folded outwardly therefrom. The upright is maintained vertical relative to the base when the brace is folded diagonally outwardly from the upright and the free end of the brace is affixed to the inner base.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows:

FIG. 1 is a diagrammatic top plan view of the present invention prior to forming; and FIG. 2 is a diagrammatic perspective view of the present invention after forming.

LIST OF REFERENCE NUMERALS UTILIZED IN THE DRAWING

10 bookend of present invention for forming from single piece of sheet metal 12.
12 single piece of sheet metal
14 pair of long edges of single piece of sheet metal 12
16 pair of short edges of single piece of sheet metal 12
18 first fold line of single piece of sheet metal 12
20 base formed by first fold line 18 of single piece of sheet metal 12 and one short edge 16 of single piece of sheet metal 12
22 upright formed by first fold line 18 of single piece of sheet metal 12 and other short edge 16 of single piece of sheet metal 12
23 brace maintaining upright 22 upright relative to base 20
24 outer base of base 20
26 inner base of base 20
28 pair of legs of outer base 24 of base 20
30 transverse portion of outer base 24 of base 20.
31 first space defined by pair of legs 28 of outer base 24 of base 20 and transverse portion 30 of outer base 24 of base 20
32 pair of legs of inner base 26 of base 20
34 transverse portion of inner base 26 of base 20
36 second space defined by pair of legs 32 of inner base 26 of base 20 and transverse portion 34 of inner base 26 of base 20
38 first slot separating inner base, 26 of base 20 from outer base 24 of base 20
40 pair of legs of upright 22
42 transverse portion of upright 22
44 third space defined by pair of legs 40 of upright 22 and transverse portion 42 of upright 22
46 second fold line
48 free end of brace 23
50 second slot separating brace 23 from pair of legs 40 of upright 22

DETAILED DESCRIPTION OF THE PREFERRED EMBODIMENT

Referring now to the figures, in which like numerals indicate like parts, and particularly to FIG 1, the bookend of the present invention is shown generally at 10 for forming from a single piece of sheet metal The configuration of the bookend 10 can best be seen in FIGS. 1 and 2, and as such, will be discussed with reference thereto.

The single piece of sheet metal 12 is rectangular-shaped, and has a pair of long edges 14 and a pair of short edges 16 that are shorter than the pair of long edges 14 thereof, respectively.

The single piece of sheet metal 12 further has a first fold line 18 that extends from one long edge 14 thereof to the other long edge 14 thereof, and is disposed closer to one short edge 16 thereof than the other short edge 16 thereof.

The first fold line 18 and the one short edge 16 form a base 20 therebetween, while the first fold line 18 and the other short edge 16 thereof form an upright 22 therebetween, with the upright 22 being maintained upright relative to the base 20 by a brace 23.

The base 20 is divided into an outer base 24 and an inner base 26 that is cut out of the outer base 24 thereof.

The outer base 24 of the base 20 is U-shaped and has a pair of legs 28 that extend outwardly from one side of the first fold line 18 and a transverse portion 30 that connects the pair of legs 28 thereof, and together therewith, defines a first space 31 therebetween.

The inner base 26 of the base 20 is U-shaped, has a pair of legs 32 that extend outwardly from the one side of the first fold line 18 and a transverse portion 34 that connects the pair of legs 32 thereof, and together therewith, defines a second space 36 therebetween that terminates just short of the first fold line 18 and is open.

The inner base 26 of the base 20 is disposed in the first space 31 of, and concentrically with, the outer base 24 of the base 20, and when folded outwardly therefrom to the other side of the first fold line 18, is coplanar with the outer base 24 of the base 20.

The inner base 26 of the base 20 is separated from the outer base 24 of the base 20 by a first slot 38 that is U-shaped and facilitates nesting of the inner base 26 of the base 20 in the outer base 24 of the base 20 and folding of the inner base 26 of the base 20 out of the outer base 24 of the base 20.

The upright 22 is U-shaped and has a pair of legs 40 that extend outwardly from the other side of the first fold line 18 and a transverse portion 42 that connects the pair of legs 40 thereof, and together therewith, defines a third space 44 therebetween.

The brace 23 is rectangular-shaped and extends from the transverse portion 42 of the upright 22, to form a second fold line 46 therewith, through the third space 44, and terminates in the first space 36, just after the first fold line 18, in a free end 48, and when folded diagonally outwardly on the second fold line 46, the free end 48 is affixed to the transverse portion 42 of the upright 22, and the upright 22 is maintained vertical relative to the base 20.

The brace 23 is separated from the pair of legs 40 of the upright 22 by a second slot 50 that facilitates nesting of the brace 23 in the upright 22 and folding of the brace 23 out of the upright 22.

It will be understood that each of the elements described above, or two or more together, may also find a useful application in other types of constructions differing from the types described above.

While the invention has been illustrated and described as embodied in a bookend for forming from a single piece of sheet metal, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoints of prior art, fairly constitute characteristics of the generic or specific aspects of this invention.

The invention claimed is:

1. A bookend, comprising a single piece of sheet metal folded into:

a) a base;

b) an upright; and c) a brace, wherein said single piece of sheet metal is rectangular-shaped, wherein said single piece of sheet metal has:

A) a pair of long edges; and

B) a pair of short edges;

wherein said pair of short edges of said single piece of sheet metal is shorter than said pair of long edges thereof, respectively, wherein said single piece of sheet metal has a first fold line;

wherein said first fold line of said single piece of sheet metal extends from one long edge thereof to the other long edge thereof; and wherein said first fold line of said single piece of sheet metal is disposed closer to one short edge thereof than the other short edge thereof, wherein said base is divided into an outer base and an inner base; and wherein said inner base of said base is cut out of said outer base thereof, wherein said outer base of said base is U-shaped;

wherein said outer base of said base has a pair of legs;

wherein said pair of legs of said outer base of said base extends outwardly from one side of said first fold line;

wherein said outer base of said base has a transverse portion;

wherein said transverse,portion of said outer base of said base connects said pair.of legs thereof; and wherein said pair of legs of said outer base and said transverse portion of said outer base define a first space therebetween.

2. The bookend as defined in claim 1, wherein said inner base of said base is U-shaped;

wherein said inner base of said base has a pair of legs;

wherein said pair of legs of said inner base of said base extends outwardly from said one side of said first fold line;

wherein said inner base of said base has a transverse portion;

wherein said transverse portion of said inner base of said base connects said pair of legs thereof;

wherein said pair of legs of said inner base of said base and said transverse portion of said inner base of said base define a second space therebetween;

wherein said second space terminates Just short of said first fold line; and wherein said second space is open.

3.The bookend as defined in claim 1, wherein said first fold line of said single piece of sheet metal and said one short edge thereof form said base therebetween;

wherein said first fold line of said single piece of sheet metal and said other short edge thereof form said upright therebetween; and wherein said upright is maintained upright relative to said base by said brace.

4. The bookend as defined in claim 1, wherein said inner base of said base is disposed in said first space of said outer base of said base;

wherein said inner base of said base is concentrically with said outer base of said base; and wherein said inner base of said base is coplanar with said outer base of said base when folded outwardly therefrom to the other side of said first fold line.

5. The bookend as defined in claim 4, wherein said upright is U-shaped;

wherein said upright has a pair of legs;

wherein said pair of legs of said upright extends outwardly from the other side of said first fold line;

wherein said upright has a transverse portion;

wherein said transverse portion of said upright connects said pair of legs thereof; and wherein said pair of legs of said upright and said transverse portion of said upright define a third space therebetween.

6. The bookend as defined in claim 5, wherein said brace is rectangular-shaped;

wherein said brace extends from said transverse portion of said upright, to form a second fold line therewith, through said third space, and terminates in said first space, just after said first fold line, in a free end; and wherein said upright is maintained vertical relative to said base when said brace is folded diagonally outwardly on said second fold line and said free end of said brace is affixed to said transverse portion of said inner base.

7. The bookend as defined in claim 5, wherein said brace is separated from said pair of legs of said upright by a second slot;

wherein said second slot facilitates nesting of said brace in said upright; and wherein said second slot facilitates folding of said brace out of said upright.

8. A bookend, comprising a single piece of sheet metal folded into:

a) a base;

b) an upright; and c) a brace, wherein said single piece of sheet metal is rectangular-shaped, wherein said single piece of sheet metal has:

A) a pair of long edges; and

B) a pair of short edges;

wherein said pair of short edges of said single piece of sheet metal is shorter than said pair of long edges thereof, respectively, wherein said single piece of sheet metal has a first fold line;

wherein said first folds line of said single piece of sheet metal extends from one long edge thereof to the other long edge thereof; and wherein said first fold line of said single piece of sheet metal is disposed closer to one short edge thereof than the other short edge thereof, wherein said base is divided into an outer base and an inner base; and wherein said inner base of said base is cut out of said outer base thereof, wherein said inner base of said base is separated from said outer base of said base by a first slot;

wherein said first slot is U-shaped;

wherein said first slot facilitates nesting of said inner base of said base in said outer base of said base; and wherein said first slot facilitates folding of said inner base of said base out of said outer base of said base.

9. The bookend as defined in claim 8, wherein said first fold line of said single piece of sheet metal and said one short edge thereof form said base therebetween;

wherein said first fold line of said single piece of sheet metal and said other short edge thereof form said upright therebetween; and wherein said upright is maintained upright relative to said base by said brace.

* * * * *